United States Patent [19]

Nigrini et al.

[11] Patent Number: 4,871,023

[45] Date of Patent: Oct. 3, 1989

[54] METHOD FOR CONTROLLING THE PH OF STEAM FLUIDS

[75] Inventors: Andrew Nigrini, La Habra Heights; Rong J. Hwang, Hacienda Heights, both of Calif.

[73] Assignee: Chevron Research Company, San Francisco, Calif.

[21] Appl. No.: 164,924

[22] Filed: Mar. 7, 1988

[51] Int. Cl.[4] ..... E21B 43/24; E21B 43/27; E21B 47/00

[52] U.S. Cl. ..... 166/252; 166/303; 166/307; 166/902; 122/459; 210/696

[58] Field of Search ..... 166/250, 252, 272, 303, 166/902, 307; 60/641.2; 122/459; 210/696, 697, 699

[56] References Cited

U.S. PATENT DOCUMENTS

| | | | |
|---|---|---|---|
| 3,367,417 | 2/1988 | McCabe | 166/303 X |
| 3,817,859 | 6/1974 | Tate | 210/696 |
| 4,454,917 | 6/1984 | Poston | 166/307 |
| 4,572,296 | 2/1986 | Watkins | 166/303 |
| 4,580,633 | 4/1986 | Watkins et al. | 166/303 X |
| 4,714,112 | 12/1987 | Nigrini et al. | 166/272 X |
| 4,719,972 | 1/1988 | Hsueh | 166/272 X |

*Primary Examiner*—George A. Suchfield
*Attorney, Agent, or Firm*—E. J. Keeling

[57] ABSTRACT

A method for controlling pH in the liquid and vapor phases of wet steam having such phases formed in a steam generator system from feedwater having therein at least one carbonate species which in the presence of steam forms a vapor phase component tending to lower the pH of the vapor phase of the steam upon condensation and a liquid phase component tending to raise the pH of the liquid phase of the steam, comprising: (a) converting the feedwater in a steam generation system to steam having a vapor phase and a liquid phase; and (b) adding to the steam generation system, a compound, selected from the group of phosphorus, arsenic, antimony, and bismuth containing compounds which are capable of forming a nonvolatile anionic component and a cationic component that, in the presence of the steam, yields hydrogen ions for reducing the pH of the liquid phase of the steam and an alkaline component for increasing the pH of the vapor phase of said steam upon condensation.

21 Claims, No Drawings

METHOD FOR CONTROLLING THE PH OF STEAM FLUIDS

BACKGROUND OF THE INVENTION

The present invention relates to a method for controlling the pH of steam fluids. More particularly, the invention relates to a method for (1) preserving the reservoir rock or gravel packing in oil wells being subjected to steam enhanced oil recovery techniques; (2) controlling corrosion produced by an acidic vapor phase condensate of the steam; and (3) improving the steam injection rate into the formation.

Steam injection techniques, such as steam stimulation and steamflooding, have been used to recover immobile heavy oils and to enhance the oil recovery from older wells where the natural field pressures are too low for unassisted production. They are designed to reduce the reservoir flow resistance by reducing the viscosity of the crude.

These techniques involve injection into the well of a high temperature wet steam in cycles of thousands of cubic meters at a time. Wet steam is a mixture of steam and varying amount of hot liquid water, the quality of wet steam generally ranging from 35% to 80%. Because of the density difference between the two phases of the wet steam, the vapor phase preferentially enters the upper part of the injection interval and the liquid phase preferentially enters the lower part.

When groundwater, river water, or lake water is used as feedwater to generate wet steam, the liquid water phase is generally basic (having a pH in excess of 11) and the vapor phase of the wet steam, when condensed, is acidic (having a pH of about 4.0 to 4.5). This partitioning is because of bicarbonate contained in the source water decomposing to $CO_2$ and $OH^-$, as shown in Equation 1 below:

$$\underset{\text{Feedwater}}{HCO_3^-} \longrightarrow \underset{\text{Vapor Phase}}{CO_2} + \underset{\text{Liquid Phase}}{OH^-} \qquad (1)$$

The $CO_2$ is volatile and enters the vapor phase, which produces a low pH in the liquids condensed from the vapor phase The $OH^-$ ion enters the liquid phase and causes a high pH in the liquid phase.

Associated with using these wet steams in steam injection is the problem of silica and silicate dissolution. Coupled with high fluid temperatures, both the liquid phase and the liquids from the condensed vapor phase are capable of rapidly dissolving reservoir rocks, such as sandstone, carbonate, diatomite, porcellanite and the like. For pH values above 11.0 and temperatures above 177° C., the silica and silicate dissolution rates are orders of magnitude higher than at neutral/ambient conditions. Also, because the reactions for dissolving siliceous reservoir rocks are base consumers in alkaline fluids, the pH of the residual fluid decreases rapidly as the fluid moves away from the wellbore, causing the dissolution reactions and solubility to diminish rapidly and causing the reaction products downstream (such as aluminosilicates and other metal silicates) to precipitate in the pores. This precipitation decreases the formation permeability and decreases well injectivity.

Dissolution of the gravel pack has been shown to be primarily a function of the pH and temperature of the injected liquid-phase water. Prior attempts at solution of the problem have focused on these aspects. For example, by keeping the pH of the injected hot water below 10, gravel pack dissolution can be decreased sharply. This may be accomplished by (1) selection of feed waters having low total carbonate concentrations (less than 10 mg total carbonate/L), (2) treating the feed water with HCl to yield the desired effluent pH, (3) using a total deionizer to remove both cations and anions from the feed water, or (4) protectively coating the gravel and/or reservoir rocks.

With regard to the first proposed solution, selection of feed waters is often impractical as the large quantities of water used are not available from a choice of sources. The second proposed solution, using HCl to neutralize the bicarbonate alkalinity, was suggested by M. G. Reed in "Gravel Pack and Formation Sandstone Dissolution During Steam Injection", Journal of Petroleum Technology, Vol. 32, pp. 941–949 (1980). But this approach suffers from considerations of cost as well as feasibility of the method. That is, addition of too much acid will cause severe corrosion of the steam generator and too little will result in insufficient depression of the pH to alleviate silica loss. With regard to the third proposed solution, the cost of a total deionizer is prohibitive, both in terms of capital costs as well as daily maintenance costs. With regard to the fourth proposed solution, complete coating of the gravel with a material, such as soybean lecithin described in U.S. Pat. No. 4,323,124, is not assured and driving the material out into the reservoir toward the production well is impractical. Furthermore, this patent does not address the problems of formation dissolution out in the formation away from the well bore.

U.S. Pat. No. 3,438,443 discloses another approach for a solution to the problem through the use of alkali metal silicates to saturate the water phase with silica and thus, hopefully, preventing the dissolution of siliceous formation material. However, alkali metal silicates are costly and the process also requires careful pH control. Moreover, they cause severe formation damage from precipitation of the added silicates.

Still other oil recovery processes as described in U.S. Pat. Nos. 3,500,931; 4,222,439; and 4,223,731 utilize chemicals, such as ammonium hydroxide, ammonium bisulfite, ammonium sulfite in separate injection steps to enhance oil recovery. However, these processes utilize the chemicals in a separate step, generally not including steam, and do not recognize the problems associated with the pH partitioning between the vapor phase of the steam and the residual water phase of the steam during the steps that include steam injection. Still another oil recovery process described in U.S. Pat. No. 4,441,555 utilizes a carbonated water flooding step before a steam drive to enhance the recovery of viscous oil. This process also does not recognize the problems of pH partitioning during steps that require a steam drive.

U.S. Pat. No. 4,475,595 to Watkins et al, filed Aug. 23, 1982, which is hereby incorporated by reference, addresses the problem of silica dissolution during steam injection. Watkins et al discuss adding an ammonium salt to the generator feedwater or to the steam itself. Ammonia gas partitions to the vapor phase leaving an acidic component to neutralize the $OH^-$ ions in the residual liquid phase.

Another problem associated with Equation (1) is its effect on the vapor phase of the steam. The carbon dioxide partitions into the vapor phase while the hydroxyl ions remain in the liquid phase. The vapor phase of the wet steam, when condensed, may have an acidic pH of about 4.0 to 4.5 resulting from the carbon dioxide combining with water to form carbonic acid, a known corrosive. Carbonic acid causes corrosion of steel conduit which it contacts and combines with alkaline earth scale which adheres to the surfaces of the pores in the reservoir, the well bore and other conduits and builds up in thickness over a period of time.

U.S. Pat. No. 4,476,930 to Watanabe, filed Aug. 23, 1982, which is hereby incorporated by reference, addresses the problem of scale inhibition during steam generation. Watanabe discusses adding an ammonium salt to the steam generator feedwater. Ammonia gas partitions to the vapor phase and inhibits the production of carbonic acid.

While some well-treating methods have met with some success, in particular applications, the need exists for a further improved steam injection treatment which simultaneously inhibits silica dissolution of gravel pack and silicate formations while controlling corrosion produced by an acidic vapor phase condensate. Accordingly, it is the principle object of this invention to provide such a method.

A further object of the present invention is to provide a method for improving overall steam injectivity into a hydrocarbon-containing formation.

A further object of the present invention is to provide a method for improving steam dump/heap leaching operations in mining and steam in situ mineral mining.

SUMMARY OF THE INVENTION

The present invention relates to an improved method for controlling pH in the liquid and vapor phases of wet steam having such phases formed in a steam generation system from feedwater having therein at least one carbonate species which in the presence of steam forms a vapor phase component tending to lower the pH of the vapor phase of the steam upon condensation and a liquid phase component tending to raise the pH of the liquid phase of the steam. It comprises: (a) converting the feedwater in a steam generation system to steam having a vapor phase and a liquid phase; and (b) adding to the steam generation system, a pH altering compound, selected from the group of phosphorus, arsenic, antimony, and bismuth containing compounds which are capable of forming a nonvolatile anionic component and a cationic component that, in the presence of said steam, yields hydrogen ions for reducing the pH of the liquid phase of said steam and an alkaline component for increasing the pH of the vapor phase of said steam upon condensation.

In an alternative embodiment, the invention comprises: (a) converting the feedwater in a steam generation system to steam having a vapor phase and a liquid phase; (b) adding to the steam generation system an acid which forms an acidic component for reducing the pH of the residual liquid phase of said steam; and (c) adding to the steam generation system, a compound selected from the group consisting of phosphorus, arsenic, antimony, and bismuth containing compounds which form an alkaline component for increasing the pH of the vapor of said steam upon condensation.

DETAILED DESCRIPTION OF THE PREFERRED EMBODIMENTS

In steam fluids, pH control is a function of the steam generator feedwater and its bicarbonate concentration. For example, the decomposition of the bicarbonate ion upon heating is according to the formula:

$$\underset{HCO_3^-}{\text{Feedwater}} \rightleftharpoons \underset{CO_2}{\text{Vapor Phase}} + \underset{OH^-}{\text{Liquid Phase}} \quad (1)$$

This causes the pH of the vapor phase of the steam (upon condensation) to drop and the pH of the residual liquid phase to increase. During steam injection, the vapor phase of the steam typically enters the upper part of the production interval while the alkaline liquid residual fluid phase enters the lower part of the production interval. But, regardless of where the vapor or liquid phases of the steam enter the production interval, the pH partitioning causes gravel pack and formation rock dissolution and increases overall maintenance costs and time.

This problem was addressed in U.S. Ser. No. 048,869 filed May 4, 1987. There the problem was addressed through the addition of ammonium salts. That application taught that the ammonium cation decomposes, allowing $NH_3$ to move into the vapor phase and its increasing pH. Simultaneously, the $H^+$ ion remained in the liquid phase to reduce its pH.

We have now discovered an entirely new set of compounds which have similar functions. Specifically, we have found that certain compounds selected from the group of phosphorus, arsenic, antimony, and bismuth containing compounds have the property of yielding hydrogen ions for reducing the pH of the liquid phase of the wet steam and an alkaline component for increasing the pH of the vapor phase of wet steam upon condensation. The selection of specific compounds depends upon the volatility and basicity of the cation.

Suitable compounds are the phosphonium, arsinium, antimonium, and bismuthium salts. Preferably these salts have chloride, hydroxide, acetate, nitrate, or sulfate anions. In another embodiment, the said phosphonium salt comprises triethyl phosphonium salt.

Tributyl phosphonium sulphate, for example, is a suitable compound. The $(C_4H_9)_3PH^+$ cation decomposes and a species thereof, i.e., $(C_4H_9)_3P$ moves into the vapor phase, according to the formula:

$$\underset{(C_4H_9)_3Ph^+}{\text{Feedwater}} \rightleftharpoons \underset{(C_4H_9)_3P}{\text{Vapor Phase}} + \underset{H^+}{\text{Liquid Phase}} \quad (2)$$

The alkaline component increases the pH of the vapor phase of the steam upon condensation and the $H^+$ neutralizes the $OH^-$ in the liquid phase and reduces its alkaline pH. The nonvolatile anionic component also drives the equilibrium of the residual liquid phase of the steam toward a reduced pH. The amount of compound required depends on the total carbonate ion concentration in the steam generator feed water. This concentration can be determined by standard carbonate titration methods, such as $CO_2$ coulometric methods. Thereafter, the desired amount of the salt is added to the feed water entering the steam generator.

Since the titration method is difficult to perform in the field, once the carbonate concentration is determined, the amount of compound to be added is adjusted by monitoring the pH of the residual liquid phase of the steam. If the pH is too high, then more compound is added. If the pH is too low, then less compound is added. The pH should be adjusted through the addition of the compound to from about pH 8.0 to about pH 10.0 and preferably from about pH 8.5 to about pH 9.5 for both the residual liquid phase and the condensed vapor phase.

Alternatively, the pH control problem can be remedied by adding a compound which decomposes in the steam generation system to form an acid neutralizer or buffer having alkaline pH values. Preferably these compounds are amides of carbamic acid and their derivatives, amides of thiocarbamic acids and their derivatives, tertiary carboxylic acid amides and their substituted and alkylated derivatives, and mixtures thereof. Urea is a particularly effective buffer. Of course adding a buffer can be combined with pH monitoring to be a very effective way of keeping the pH of the liquid phase between 8.5 and 9.5.

Another problem associated with heating a bicarbonate-containing feedwater as shown by Equation (1), is the partitioning of $CO_2$ into the vapor phase of the wet steam. When the vapor phase is condensed, the $CO_2$ forms carbonic acid and may result in a vapor phase condensate having a pH in the 4.0 to 4.5 range. This problem is also remedied by the present invention. The alkaline component in the vapor phase of the wet steam raises the pH of the condensed vapor phase and effectively inhibits corrosion.

In an alternative embodiment, the problem of silica dissolution is addressed by adding an acid to the steam generation system directly to titrate the hydroxide ions produced by Equation (1). Simultaneously, a compound which forms an alkaline component for increasing the pH of the vapor phase of the steam upon condensation is added to the wet steam to control corrosion resulting from the vapor phase condensate. Any acid which forms an acidic component in the residual liquid phase of the wet steam when heated is suitable for this purpose. Useful acids include the halogen acids, sulfuric acid, phosphoric acid, acetic acid, nitric acid, and mixtures thereof. The amount of acid required initially depends on the total carbonate ion concentration in the steam generator feedwater. In general, the amount of acid added is the stoichiometric amount of bicarbonate present in the feedwater. The desired initial amount of acid is added to reduce the pH of the residual liquid phase of the wet steam to within the range of from 8.0 to 10.0, preferably within the range of from 8.5 to 9.5.

Suitable alkaline component forming compounds are those selected from the group of phosphorus, arsenic, antimony, or bismuth containing compounds. Preferably are selected from the group of phosphine, arsine, stilbine, and bismuthine. One embodiment consists of injecting a wet steam including an amount of hydrochloric acid effective to reduce the pH of the residual liquid phase of said wet steam to a range of about 8.5 to 9.5; and an amount of anhydrous alkylphosphine is added to the said wet steam itself effective to inhibit corrosion in the vicinity of the vapor phase condensate.

To control the problem of corrosion resulting from acid overtreatment, the pH of the residual liquid phase may be continuously monitored and the addition of acid continuously adjusted. Preferably, the pH of the residual liquid phase is maintained between 8.0 and 10.0, preferably between 8.5 and 9.5. Alternatively, a buffer or acid neutralizer such as urea can be used alone or in conjunction with pH monitor to control acid overtreatment

EXAMPLES

Example 1

The following table illustrates suitable stoichiometric concentrations of tributyl phosphonium sulphate and tributyl phosphonium chloride for steam generator feedwaters having total carbonate concentrations from 50 ppm to 1000 ppm.

TABLE

| Steam Feedwater Carbonate Conc. | Tributyl Phosphonium Sulfate | | Tributyl Phosphonium Chloride | |
|---|---|---|---|---|
| (ppm) | g/bbl | g/l | g/bbl | g/l |
| 50 | 32.7 | .21 | 31.1 | .20 |
| 250 | 164. | 1.03 | 155. | .98 |
| 1000 | 654. | 4.11 | 620. | 3.92 |

For a typical 350-barrel per day (BPD) steam injection project with a carbonate concentration of 250 ppm, the daily phosphonium sulfate salt consumption will be about 60 kilograms. However, this will cause about a 20-fold decrease in the silica dissolution rate at an adjusted pH of about 9.1.

The process is suitable for use within cyclic steam injection or patterned steam injection involving the use of injection wells and production wells, i.e., four-spot, five-spot, nine-spot, their inverted forms, and the like. In addition, it can be used with surfactants and steam-foam drives. Suitable surfactants are known anionic, cationic or nonionic surfactants. Preferred surfactants for steam-foam enhanced oil recovery drives are known as alpha olefin sulfonates and their dimers as described in U.S. Pat. No. 3,721,707, incorporated herein by reference. Furthermore, the steam drive does not have to be continuous so long as any displacing medium does not substantially alter the preferred pH of the residual liquid phase of the steam in the formation.

Computer simulation experiments using a feedwater containing 0.001 equivalents bicarbonate ion indicate that the residual phase pH is reduced from a pH of about 10.9 to about 8.2 with the addition of 0.001 equivalents of Tributyl Phosphonium Sulfate. The pH of the condensed vapor phase increases from about pH 4.5—without the salt to about pH 8.3 with the salt addition. A similar result is obtained with the addition of 0.001 equivalents of Tributyl Phosphonium Chloride.

Example 2

An alternate method of addition is to add Tributyl Phosphine (liquid) along with a stoichiometrically equivalent acid such as sulfuric, hydrochloric, etc. These compounds are blended into the feedwater stream with a static mixer at rates appropriate to achieve concentrations stoichiometrically equivalent to the bicarbonate ion concentration. Addition in this manner allows for separate control of pH values in the vapor and residual fluids by varying the ratios of the Tributyl Phosphine to acid additions. For example, to achieve target pH of approximately 9.0 for both the vapor and residual liquid phases, computer simulations indicate that with a 0.001 M bicarbonate feedwater, approximately 0.003 equivalents of Tributyl Phosphine and 0.0004 equivalents of Sulfuric Acid would be required.

While the present invention has been described with reference to specific embodiments, this application is intended to cover those various changes and substitutions which may be made by those skilled in the art without departing from the spirit and scope of the appended claims.

What is claimed is:

1. A method for controlling pH in the liquid and vapor phases of wet steam having such phases formed in a steam generation system from feedwater having therein at least one carbonate species which in the presence of steam forms a vapor phase component tending to lower the pH of the vapor phase of the steam upon condensation and a liquid phase component tending to raise the pH of the liquid phase of the steam, comprising:

(a) converting the feedwater in a steam generation system to steam having a vapor phase and a liquid phase; and (b) adding to the steam generation system, a pH altering compound, selected from the group of phosphorus, arsenic, antimony, and bismuth containing compounds which are capable of forming a nonvolatile anionic component and a cationic component that, in the presence of said steam, yields hydrogen ions for reducing the pH of the liquid phase of said steam and an alkaline component for increasing the pH of the vapor phase of said steam upon condensation.

2. A method, according to claim 1, wherein said pH altering compound is selected from the group of phosphonium salts, arsinium salts, antimonium salts, and bismuthium salts.

3. A method, according to claim 2, wherein said phosphonium salts are selected from the group consisting of phosphonium chloride, phosphonium hydroxide, phosphonium acetate, phosphonium nitrate, phosphonium sulfate, and mixtures thereof.

4. A method, according to claim 3, wherein said phosphonium salt comprises triethyl phosphonium salt.

5. A method, according to claim 3, wherein said phosphonium salt comprises tributyl phosphonium sulphate.

6. A method, according to claim 2, wherein said arsinium salt is selected from the group consisting of arsinium chloride, arsinium hydroxide, arsinium acetate, arsinium nitrate, arsinium sulfate, and mixtures thereof.

7. A method, according to claim 2, wherein said antimonium salt is selected from the group consisting of antimonium chloride, antimonium hydroxide, antimonium acetate, antimonium nitrate, antimonium sulfate, and mixtures thereof.

8. A method, according to claim 2, wherein said bismuthium salt is selected from the group consisting of bismuthium chloride, bismuthium hydroxide, bismuthium acetate, bismuthium nitrate, bismuthium sulfate, and mixtures thereof.

9. A method, according to claim 1, further comprising:

monitoring the pH of the residual liquid phase of said steam and continually adjusting the addition of said pH altering compound to maintain the pH of said liquid phase within the range of about 8.0 to about 10.0.

10. A method, according to claim 9, wherein the pH ranges from about 8.5 to about 9.5.

11. A method, according to claim 1, further comprising:

adding to the steam generation system a compound which decomposes in said system to form acid neutralizers or buffers having alkaline pH values.

12. A method, according to claim 11, wherein said decomposing compound is selected from the group consisting of amides of carbamic acid and derivatives thereof, amides of thiocarbamic acids and derivatives thereof, tertiary carboxylic acid amides and their substituted and alkylated derivatives and mixtures thereof.

13. A method, according to claim 12, wherein said decomposing compound is urea.

14. A method for controlling pH in the liquid and vapor phases of wet steam having such phases formed in a steam generation system from feedwater having therein at least one carbonate species which, in the presence of steam, forms a vapor phase component tending to lower the pH of the vapor phase of the steam upon condensation and a liquid phase component tending to raise the pH of the liquid phase of the steam, comprising:

(a) converting the feedwater in a steam generation system to steam having a vapor phase and a liquid phase;

(b) adding to the steam generation system, a pH altering compound comprising phosphonium sulfate which is capable of forming a nonvolatile anionic component and a cationic component that, in the presence of said steam, yields hydrogen ions for reducing the pH of the liquid phase of said steam and an alkaline component for increasing the pH of the vapor phase of said steam upon condensation;

(c) adding to the steam generation system a compound comprising urea which decomposes in said system to form acid neutralizers or buffers having alkaline pH valves; and (d) monitoring the pH of the residual liquid phase of said steam and continually adjusting the addition of said comprising urea to maintain the pH of said liquid phase within the range of about 8.5 to about 9.5.

15. A method for controlling pH in the liquid and vapor phases of wet steam having such phases formed in a steam generation system from feedwater having therein at least one carbonate species which in the presence of steam forms a vapor phase component tending to lower the pH of the vapor phase of the steam upon condensation and a liquid phase component tending to raise the pH of the liquid phase of the steam, comprising:

(a) converting the feedwater in a steam generation system to steam having a vapor phase and a liquid phase;

(b) adding to the steam generation system an acid which forms an acidic component for reducing the pH of the residual liquid phase of said steam; and (c) adding to the steam generation system, a compound selected from the group of phosphorus, arsenic, antimony, and bismuth containing compounds which forms an alkaline component for increasing the pH of the vapor phase of said steam upon condensation.

16. A method, according to claim 15, wherein said alkaline component forming compound is selected from the group of phosphine, arsine, stibene, and bismuthine.

17. A method, according to claim 15, wherein said acid is selected from the group consisting of the halogen acids, sulfuric acid, phosphoric acid, acetic acid, nitric acid, and mixtures thereof.

18. A method, according to claim 15, further comprising:

monitoring the pH of the residual liquid phase of said steam and continually adjusting the addition of said acid to maintain the pH of said liquid phase within the range of about 8.0 to about 10.0.

19. A method, according to claim 18, wherein the pH ranges from about 8.5 to about 9.5.

20. A method of inhibiting silica dissolution in the vicinity of a well penetrating a hydrocarbon-containing formation, while preventing pipe corrosion, comprising:

(a) injecting a wet steam including an amount of hydrochloric acid effective to reduce the pH of the residual liquid phase of said wet steam to a range of about 8.5 to about 9.5, an amount of anhydrous alkylphosphine added to the said wet steam itself effective to inhibit corrosion in the vicinity of the vapor phase condensate; and (b) monitoring the pH of the residual liquid phase of said wet steam and continually adjusting the addition of said hydrochloric acid to maintain the pH of said liquid phase within the range of from about 8.5 to about 9.5.

21. A method of inhibiting silica dissolution in the vicinity of a well penetrating a hydrocarbon-containing formation, while preventing pipe corrosion, comprising:

a. injecting a wet steam including an amount of hydrochloric acid effective to reduce the pH of the residual liquid phase of said wet steam to a range of about 8.5 to about 9.5, an amount of an alkaline component forming compound, selected from the group of arsine, stibene, or bismuthene-containing compounds, added to the said wet steam itself effective to inhibit corrosion in the vicinity of the vapor phase condensate; and b. monitoring the pH of the residual liquid phase of said wet steam and continually adjusting the addition of said hydrochloric acid to maintain the pH of said liquid phase within the range of from about 8.5 to about 9.5.

* * * * *